United States Patent [19]

Barnes

[11] Patent Number: 4,988,363

[45] Date of Patent: Jan. 29, 1991

[54] DETERGENT BLEACH COMPOSITION AND METHOD OF CLEANING FABRICS

[75] Inventor: Stephen G. Barnes, Hooton, Great Britain

[73] Assignee: Lever Brothers Company, Division of Conopco, Inc., New York, N.Y.

[21] Appl. No.: 366,218

[22] Filed: Jun. 15, 1989

Related U.S. Application Data

[63] Continuation of Ser. No. 189,578, May 3, 1988, abandoned.

[30] Foreign Application Priority Data

May 6, 1987 [GB] United Kingdom ..... 8710690

[51] Int. Cl.[5] ..... D06L 3/02; D06L 3/04

[52] U.S. Cl. ..... 8/111; 8/137; 252/100; 252/102; 252/103

[58] Field of Search ..... 252/103, 95, 99, 186.1, 252/186.25, 100, 103; 8/111, 137

[56] References Cited

U.S. PATENT DOCUMENTS

| | | | |
|---|---|---|---|
| 3,042,621 | 7/1962 | Kirschenbauer | 252/99 |
| 4,100,095 | 7/1978 | Hutchins et al. | 252/99 |
| 4,170,453 | 10/1979 | Kitko | 252/95 |
| 4,259,201 | 3/1981 | Cockrell, Jr. et al. | 252/103 |

FOREIGN PATENT DOCUMENTS

| | | |
|---|---|---|
| 1000628 | 11/1976 | Canada . |
| 37146 | 10/1981 | European Pat. Off. . |
| 1456591 | 11/1976 | United Kingdom . |

*Primary Examiner*—Paul Lieberman
*Assistant Examiner*—John F. McNally
*Attorney, Agent, or Firm*—Milton L. Honig

[57] ABSTRACT

Detergent bleach compositions containing an organic peroxyacid having solution pH above 9 which changes to below 9 after 4–10 minutes. Method for washing fabrics, comprising the steps of contacting the fabric with an aqueous solution of a detergent composition containing a peroxyacid at pH above 9 for 4–10 minutes and thereafter acidifying the wash liquor to a pH of below 9.

6 Claims, 1 Drawing Sheet

DETERGENT BLEACH COMPOSITION AND METHOD OF CLEANING FABRICS

This is a continuation application of Ser. No. 189,578, filed May 3, 1988, now abandoned.

FIELD OF THE INVENTION

This invention relates to an improved detergent bleaching composition comprising an organic peroxyacid as the bleaching agent and to a method for improving the cleaning of fabrics with a detergent composition including an organic peroxyacid bleaching agent.

1. Background Technology

Most washing processes applied to fabrics involve a combination of physical, physico-chemical and chemical actions.

Soil removal from fabrics is an extremely complex affair and to date there are no theories which give adequate account of the processes involved. One of the most important parameters in detergency is the temperature of the wash liquor. A second important parameter is the free calcium ion and active detergent level. Most soils respond positively to decrease in free calcium ion concentration and to increase in active detergent level. Another important parameter in detergency is pH. In general, the lower the pH the poorer the physical cleaning will be.

Apart from physical and physico-chemical soil removal, bleaching and stain removal by chemical reaction can play an important role in fabric washing. In practice, very few washes are conducted under absolutely constant conditions. Soil will release calcium ion and proton into the wash liquor, which will raise the free calcium content and lower the pH, during the course of the wash. In addition, most washing machines have a heat-up cycle during which there is some agitation and therefore some soil removal.

With the above factors taken into account, commercial fabric-washing products are generally formulated as an alkaline built detergent composition having solution pH of about 9.5–11.0.

2. Background Art

It is well known in washing and/or bleaching of textiles to make use of compositions containing, inter alia, inorganic peroxide bleaching agents, such as the alkali metal perborates, percarbonates, perphosphates, persilicates and the like, which liberate hydrogen peroxide in aqueous solution. However, washing and/or bleaching compositions containing said peroxide compounds have the disadvantage that their bleaching effect is relatively low at temperatures below 80° C. and substantially nil at temperatures below 60° C., which gives rise to difficulties when these compositions are used in domestic washing machines at temperatures below 70° C.

The addition of organic bleaching activators for the peroxide compound to such compositions is also known, owing to which the active oxygen of the peroxide compound becomes effective at lower temperatures, e.g. from 40–60° C. Such compositions are believed to function by the generation of organic peroxyacids during use, for example peroxyacetic acid. A fundamental problem in systems of this type is that the peroxyacid is generated in situ, which under practical conditions can give rise to yield difficulties.

Organic peroxyacids as a class are quite effective bleaches, and the use of organic peroxyacid compounds per se, particularly the solid organic peroxyacid compounds, as the bleach system in detergent compositions has been proposed in the art, e.g. in GB Patent No. 1 456 591, U.S. Pat. No. 4,100,095 and EP-B-00 37 146.

However, organic peroxyacid compounds when used together with alkaline built detergent compositions for washing textiles under the normal washing machine conditions appeared not to exert the desired optimal effect as expected.

It is an object of the present invention to improve the overall cleaning and washing effect of detergent bleach compositions comprising an organic peroxyacid compound.

It is another object of the invention to provide a method for washing fabrics using a detergent composition including an organic peroxyacid bleaching agent.

It is a further object of the invention to secure optimal utilization of organic peroxyacid bleach compounds in the washing of fabrics.

SUMMARY OF THE INVENTION

It has now been found that these and other objects which will be apparent in the further description can be achieved if washing is carried out under careful profiling of the wash liquor pH.

To be effective as a low-temperature stain bleach, organic peroxyacids must be used at a wash pH of below 9. Conventional detergent powder compositions, on the other hand, are, as explained hereinbefore, substantially more alkaline and, because detergency generally improves with increasing pH, it is anticipated that detergency losses will be apparent under the conditions required for organic peroxyacid efficacy.

The invention now provides a way to reconcile the conflicting requirements of peroxyacid bleaching and detergency, in that a short wash at high pH followed by a longer wash period at lower pH will result in effective detergency without adverse consequences for bleach efficacy or equally effective bleaching without adverse consequences for detergency.

Accordingly, in one aspect the invention provides a bleach detergent composition comprising an organic peroxyacid as the bleaching agent, characterized in that the composition exerts an initial solution pH of above 9, preferably from 9.5–11.0, which maintains for above a period of 4–10 minutes, preferably 4–6 minutes, particularly 5–6 minutes, and thereafter changes to a solution pH of below 9, preferably from 7.3–8.5. In another aspect the invention provides a method for washing and cleaning of fabrics using a detergent composition comprising an organic peroxy acid, said method comprising the steps of contacting the fabric with an aqueous solution of said detergent composition having a pH of above 9, preferably from 9.5–11.0 for about 4–10 minutes, preferably 4–6 minutes, particularly 5–6 minutes, and thereafter acidifying the wash liquor to a pH of below 9, preferably from 7.3–8.5 for the rest of the washing period.

Generally, a washing time at the low pH range of 10 minutes to not more than 30 minutes will be sufficient, but even longer washing times can also be applied if desired without adversely affecting the total washing performance.

The above-described pH profiling can be applied at any washing temperature from 20° C. to about 95° C., but is preferably applied at temperatures up to 60° C., either under isothermal wash conditions or in a heat-up cycle wash.

The required pH levels apply to solutions of the detergent bleach composition at concentrations of from about 2 to 6 g/l.

BRIEF DESCRIPTION OF THE DRAWING

The objects, features and advantages of the present invention will more fully be appreciated with reference to the accompanying drawing in which.

Figure 1:
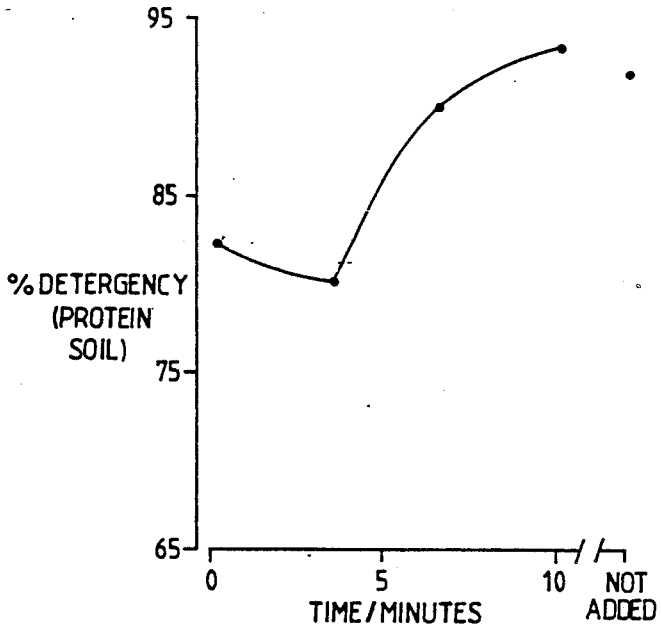
FIG. 1 is a graph profiling detergency benefits according to the present invention.

The gist of the present invention is that, provided the initial wash period and condition for effective detergency are good, this effective detergency is maintained for the rest of the washing period irrespective of the subsequent worsening of the wash condition at lower pH.

The initial high pH wash period needed may depend upon the formulation. Although in some cases an initial wash period of less than 4 minutes can be sufficient, it has been found that 4 minutes to not more than 10 minutes is the right timing to secure and maintain effective detergency for the rest of the washing period.

Profiling of the wash liquor pH can be effected by simply adding an acid, e.g. sulphuric acid, to the wash liquor at the correct time in an amount sufficient to cause the pH drop.

Alternatively, the detergent bleach composition is provided with a pH-profiling means, for example by using a sachet containing an acidic substance or encapsulated or coated acid particles, which release the contents at a pre-determined time in the wash liquor.

Various constructions of sachets provided with means for delaying release of the contents are known in the art, such as for example a water-permeable tea-bag type sachet provided with a pore-occluding external coating or layer of e.g. high molecular weight fatty acid, polyethylene glycol and polymeric material, or a sachet of water-impermeable material provided with a temperature release sealing. Likewise, the technique of coating and/or encapsulating particles is known in the art, and a man skilled in the art will have no problem in selecting a suitable coating or layer material for delayed release. Any acid substance can in principle be used in the present invention for effecting the pH-drop, such as for example sodium bisulphite, sodium hydrogen sulphate, sodium hydrogen phosphates, citric acid etc., and mixtures thereof.

The detergent bleach composition of the invention must have an initial solution pH as defined of above 9, preferably from 9.5–11, and may contain any of the common detergency builders such as carbonates, phosphates, silicates and aluminosilicates, e.g. zeolites. They can be present in the detergent composition in amounts from 5% to 80%, preferably from 10–60% by weight; the upper limit is defined only by formulation constraints. This allows for the control of wash water hardness so that detergency can be maximized. Also, common sequestrants such as ethylene diamine tetraacetate (EDTA), diethylene triamine pentaacetate (DETpA) or the various phosphonates, e.g. amino trimethylene phosphonic acid pentasodium salt (Dequest 2006) or ethylene diamine tetramethylene phosphonic acid (Dequest) 2040) can be added typically at levels of about 0.05% to about 0.3% by weight. Examples of organic builders are alkylmalonates, alkylsuccinates, polyacrylates, nitrilotriacetates (NTA), citrates, carboxy methyloxy malonates and carboxy methyloxy succinates.

The detergent bleach compositions of the invention further contain a surface-active agent or surfactant, generally in an amount of from about 2% to 50% by weight, preferably from 5% to 30% by weight. The surface-active agent can be anionic, nonionic, cationic or zwitterionic or a mixture of such agents.

Nonionic surfactants suitable for use in the present invention include water-soluble compounds produced by the condensation of ethylene oxide with a hydrophobic compound such as an alcohol, alkyl phenol, polypropoxy glycol or polypropoxy ethylene diamine. Also suitable are alkyl amine oxides, alkyl polyglucosides and alkyl methylsulphoxides. Preferred nonionic surfactants are polyethoxy alcohols formed as the condensation products of 1 to 30 moles of ethylene oxide with 1 mole of branched- or straight-chain, primary or secondary aliphatic alcohols having from about 8 to about 22 carbon atoms; more especially, 6 to 15 moles of ethylene oxide are condensed with 1 mole of straight-or branched-chain, primary or secondary aliphatic alcohol having from about 10 to about 16 carbon atoms. Certain polyethoxy alcohols are commercially available under the trade-names "Neodol"®, "Synperonic"® and "Tergitol"®.

Anionic surfactants suitable for use in formulating the detergent bleach compositions of the invention include water-soluble alkali metal alkylbenzenesulphonates, alkyl sulphates, alkylpolyethoxyether sulphates, paraffin sulphonates, alpha-olefin sulphonates, alpha-sulphocarboxylates and their esters, alkylglycerylether sulphonates, fatty acid monoglyceride sulphates and sulphonates, alkylphenolpolyethoxy ethersulphates, 2-acyloxyalkane-1-sulphonates and beta-alkyloxyalkane sulphonates. Soaps can also be used as anionic surfactants. Preferred anionic surfactants are alkylbenzenesulphonates with about 9 to about 15 carbon atoms in a linear or branched alkyl chain, more especially about 11 to about 13 carbon atoms; alkylsulphates with about 8 to about 22 carbon atoms in the alkyl chain, more especially from about 12 to about 18 carbon atoms; alkylpolyethoxy ethersulphates with about 10 to about 18 carbon atoms in the alkyl chain and an average of about 1 to about 12 —$CH_2CH_2O$-groups per molecule; linear paraffin sulphonates with about 8 to about 24 carbon atoms, more especially from about 14 to about 18 carbon atoms and alpha-olefin sulphonates with about 10 to about 24 carbon atoms, more especially about 14 to about 16 carbon atoms; and soaps having from 8 to 24, especially 12 to 18 carbon atoms.

Cationic surface-active agents suitable for use in the invention include the quaternary ammonium compounds, e.g. cetyltrimethylammonium bromide or chloride and distearyldimethylammonium bromide or chloride, and the fatty alkyl amines.

Zwitterionic surfactants that can be used in the present invention include water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyldimethylammonium propanesulphonates and carboxylates (betaines) and alkyldimethylammoniohydroxy propanesulphonates and carboxylates wherein the alkyl group in both types contains from about 8 to 18 carbon atoms.

Typical listings of the classes and species of surfactants useful in this invention appear in "Surface Active Agents", vol. I, by Schwartz & Perry (Interscience 1949) and "Surface Active Agents", vol. II, by Schwartz, Perry & Berch (Interscience 1958). These listings, and the foregoing recitation of specific surfactant compounds and mixtures can be used in formulating the detergent bleach composition of the present invention.

The organic peroxyacid compounds used in the present invention are solid at room temperature and should preferably have a melting point of at least 50° C. The amount thereof in the bleach detergent composition of the invention will normally be in the range of from 1 to 25% by weight, preferably from 2 to 10% by weight.

Such peroxyacid compounds are the organic peroxyacids and water-soluble salts thereof having the general formula:

$$HO-O-\overset{\overset{\displaystyle O}{\|}}{C}-R-Y,$$

wherein R is an alkylene or substituted alkylene group containing 1 to 20 carbon atoms or an arylene group containing from 6 to 8 carbon atoms, and Y is hydrogen, halogen, alkyl, aryl or any group which provides an anionic moiety in aqueous solution. Such Y groups can include, for example:

$$-\overset{\overset{\displaystyle O}{\|}}{C}-OM;\quad -\overset{\overset{\displaystyle O}{\|}}{C}-O-OM;\quad \text{or}\quad -\underset{\underset{\displaystyle O}{\|}}{\overset{\overset{\displaystyle O}{\|}}{S}}-OM$$

wherein M is H or a water-soluble, salt-forming cation.

The organic peroxyacids and salts thereof usable in the present invention can contain either one, two or more peroxy groups and can be either aliphatic or aromatic.

When the organic peroxyacid is aliphatic, the unsubstituted acid may have the general formula:

$$HO-O-\overset{\overset{\displaystyle O}{\|}}{C}-(CH_2)_n-Y$$

wherein Y can be H, $-CH_3$, $-CH_2Cl$, $$-\overset{\overset{\displaystyle O}{\|}}{C}-OM,\quad -\underset{\underset{\displaystyle O}{\|}}{\overset{\overset{\displaystyle O}{\|}}{S}}-OM\quad \text{or}\quad -\overset{\overset{\displaystyle O}{\|}}{C}-O-OM$$

and n can be an integer from 6 to 20.

Peroxydodecanoic acids, peroxytetradecanoic acids and peroxyhexadecanoic acids are the preferred compounds of this type, particularly 1,12-diperoxydodecanedioic acid, 1,14-diperoxytetradecanedioic acid and 1,16-diperoxyhexadecanedioic acid. Examples of other preferred compounds of this type are diperoxyazelaic acid, diperoxyadipic acid and diperoxysebacic acid.

When the organic peroxyacid is aromatic, the unsubstituted acid may have the general formula:

$$HO-O-\overset{\overset{\displaystyle O}{\|}}{C}-C_6H_4-Y$$

wherein Y is, for example, hydrogen, halogen, alkyl, $$-\overset{\overset{\displaystyle O}{\|}}{C}-OM,\quad -\underset{\underset{\displaystyle O}{\|}}{\overset{\overset{\displaystyle O}{\|}}{S}}-OM,\quad -\underset{\underset{\displaystyle O}{\|}}{\overset{\overset{\displaystyle O}{\|}}{S}}-C_6H_4-\overset{\overset{\displaystyle O}{\|}}{C}-O-OM\quad \text{or}$$

$$-\overset{\overset{\displaystyle O}{\|}}{C}-O-OM.$$

The percarboxy and Y groupings can be in any relative position around the aromatic ring. The ring and/or Y group (if alkyl) can contain any non-interfering substituents such as halogen or sulphonate groups. Examples of suitable aromatic peroxyacids and salts thereof include monoperoxyphthalic acid, diperoxyterephthalic acid, 4-chlorodiperoxyphthalic acid, diperoxyisophthalic acid, peroxy benzoic acids and ring-substituted peroxy benzoic acids, such as peroxy-alpha-naphthoic acid. A preferred aromatic peroxyacid is diperoxyisophthalic acid.

The particularly preferred peroxyacid for use in the present invention is 1,12-diperoxydodecanedioic acid (DPDA).

The organic peroxyacids are preferably used as the sole bleaching agent. It should be appreciated, however, that other bleaching agents, e.g. hydrogen peroxide adducts, such as perborates or percarbonates, may also be incorporated as additional bleach, provided they do not affect the basic pH-profile principle.

Typically, a bleach detergent composition of the invention contains furthermore an acid substance in a form delaying its acidifying action in solution not more than 10 minutes and in an amount sufficient to cause a pH drop from above 9 to below 9, preferably from a pH range of 9.5–11 to a pH range of 7.3–8.5.

Other components/adjuncts commonly used in detergent compositions and which can be used in the instant detergent bleach compositions include soil-suspending agents/incrustation inhibitors, such as water-soluble salts of carboxymethylcellulose, carboxyhydroxymethylcellulose, copolymers of maleic anhydride and vinyl ethers, copolymers of maleic acid (anhydride) and (meth)acrylic acid, polyacrylates and polyethylene glycols having a molecular weight of about 400 to 10,000 or more. These can be used at levels of about 0.5% to about 10% by weight.

Dyes, pigments, optical brighteners, perfumes, anticaking agents, suds control agents, enzymes and fillers can also be added in varying amounts as desired.

Enzymes which can be used herein include proteolytic enzymes, amylolytic enzymes and lipolytic enzymes (lipases). Various types of proteolytic enzymes and amylolytic enzymes are known in the art and are commercially available.

The invention can be applied to solid, particulate or liquid detergent bleach compositions, which can be manufactured according to any convenient technique known in the art.

EXAMPLE pH-profiling experiments were carried out in a Miele® 423 washing machine using a detergent composition containing diperoxy dodecanedioic acid (DPDA) at a dosage of 5 g/l under the following wash conditions:

| | |
|---|---|
| 40° C. heat-up cycle (20 minutes total wash time) | |
| 2.5 kg clean load and | |
| test swatches soiled with | |
| (a) protein soil | |
| (b) tea | |
| (c) red wine | |
| 15.5 liters of | |
| 20° F.H. water for the main wash and | |
| 20° F.H. water in the rinse cycle. | |
| Detergent composition used | parts by weight |
| $C_{12}$-alkyl benzene sulphonate | 9 |
| nonionic ethoxylate | 4 |
| sodium triphosphate | 25 |
| sodium carbonate | 10 |
| alkaline sodium silicate | 5 |
| sodium sulphate | 16 |
| DPDA granule (12% active content) | 20 |

The washing powder was dispensed into the machine in the normal way and 4 mmoles/l $H_2SO_4$ were added at various times during the wash cycle, whereby the pH dropped from an initial value of 10.5 to about 7.5–8.0. The pCa dropped from an initial value of 5.4 to about 4.8–5.0.

The detergency benefits obtained from profiling are shown in FIG. 1. Detergency performance on protein-soiled test cloths (in % soil removal) was set out against time (in minutes) of wash cycle before acid addition. The results show that, if addition of acid is delayed by 5–10 minutes, significant improvements in soil removal are apparent and the detergency is not far short of that obtained if acid is not added, i.e. if the wash is maintained at a high pH throughout the cycle (see dot at far right).

Figure 2:
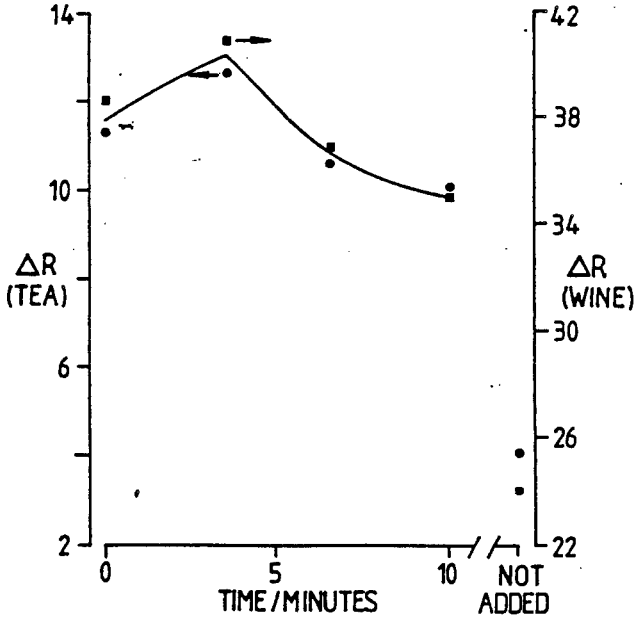
FIG. 2 is a graph profiling bleaching benefits against tea and red wine stains, according to the present invention.

The corresponding consequences for bleaching on two common stains, tea (left axis) and red wine (right axis ) are shown in FIG. 2, in which bleach monitor response ($\Delta R$)=reflectance) is plotted against time (in minutes) of wash cycle before acid addition. These results reveal that if the addition of acid is delayed by the same 5–10 minutes then stain removal is not greatly affected. The dots at bottom right of the figure show the results if acid is not added.

Taken together, the best combination of detergency and bleaching is clearly obtained if the wash is correctly profiled at high pH for 4–10 minutes, particularly for 5–6 minutes, and subsequently at lower pH for the rest of the washing time.

I claim:

1. A method for washing and cleaning of fabrics using a detergent composition containing an organic peroxyacid in an effective amount to bleach said fabrics, a surfactant and a detergent builder each present in an effective amount to clean said fabrics, comprising the steps of contacting the fabric with an aqueous solution of said detergent composition at a pH of 9.5–11.0 for about 4–10 minutes, and thereafter acidifying the aqueous solution to a pH of 7.3–8.5 for the rest of the washing period.

2. A method for washing fabrics according to claim 1, wherein the contact time of the fabric with the aqueous wash solution before acid addition is 4–6 minutes.

3. A method for washing fabrics according to claim 1, wherein the washing time at pH of 9.5–11.0 range is from 10 to 30 minutes.

4. A method for washing fabrics according to claim 1, wherein said washing is carried out at a temperature of from 20° C. to 60° C.

5. A method for washing fabrics according to claim 1, wherein said organic peroxyacid is 1,12-diperoxydodecanedioic acid.

6. A method for washing fabrics according to claim 1, wherein the acidifying step is accomplished by adding to the aqueous solution an acid substance selected from the group consisting of sodium bisulphite, sodium hydrogen sulphate, sodium hydrogen phosphate, citric acid and mixtures thereof.

* * * * *